US008559647B2

(12) United States Patent
Ukai et al.

(10) Patent No.: US 8,559,647 B2
(45) Date of Patent: Oct. 15, 2013

(54) SOUND EMITTING AND COLLECTING APPARATUS

(75) Inventors: Satoshi Ukai, Hamamatsu (JP); Satoshi Suzuki, Toyohashi (JP)

(73) Assignee: Yamaha Corporation (JP)

( * ) Notice: Subject to any disclaimer, the term of this patent is extended or adjusted under 35 U.S.C. 154(b) by 226 days.

(21) Appl. No.: 12/679,315

(22) PCT Filed: Sep. 5, 2008

(86) PCT No.: PCT/JP2008/066108
§ 371 (c)(1),
(2), (4) Date: Mar. 22, 2010

(87) PCT Pub. No.: WO2009/037985
PCT Pub. Date: Mar. 26, 2009

(65) Prior Publication Data

US 2010/0208907 A1 Aug. 19, 2010

(30) Foreign Application Priority Data

Sep. 21, 2007 (JP) ..... 2007-245187

(51) Int. Cl.
*G10K 11/16* (2006.01)

(52) U.S. Cl.
USPC ..... 381/71.1; 381/71.11

(58) Field of Classification Search
USPC ..... 381/71.1, 71.2, 71.7, 71.9, 95, 96, 381/71.11, 66
See application file for complete search history.

(56) References Cited

U.S. PATENT DOCUMENTS

| | | | |
|---|---|---|---|
| 5,778,085 | A | 7/1998 | Sasaki |
| 6,516,066 | B2 | 2/2003 | Hayashi |
| 6,804,358 | B1 | 10/2004 | Kawano |
| 2001/0028719 | A1 | 10/2001 | Hayashi |
| 2003/0053620 | A1 | 3/2003 | Chen |
| 2003/0072460 | A1 | 4/2003 | Gonopolskiy |

(Continued)

FOREIGN PATENT DOCUMENTS

| | | | |
|---|---|---|---|
| EP | 56-117497 | A | 9/1981 |
| JP | 05-086833 | A | 4/1993 |

(Continued)

OTHER PUBLICATIONS

"Acoustic systems and digital technology" edited by Juro Ohga, Yoshio Yamasaki, and Yutaka Kaneda. The Institute of Electronics, Information and Communication Engineers, 1995, pp. 210-211. Cited in spec.

(Continued)

*Primary Examiner* — Mohammad Islam
*Assistant Examiner* — David Ton
(74) *Attorney, Agent, or Firm* — Rossi, Kimms & McDowell LLP

(57) ABSTRACT

A sound emitting and collecting apparatus that can accomplish stable echo removal if the relative positions of a loudspeaker and a microphone change is provided. A control section 52 inputs information of an arm rotation angle from a sensor 54. The control section 52 reads the filter coefficient corresponding to the input rotation angle from memory 53 and sets the coefficient in an adaptive filter 412A. When the arm rotates, the installing position of a microphone is changed and an acoustic transmission system changes, but a preset (or in the installing environment, updated) filter coefficient is set, whereby stable echo removal can be accomplished.

2 Claims, 6 Drawing Sheets

| ROTATION ANGLE OF ARM 11R | FILTER COEFFICIENT OF ADAPTIVE FILTER 412A | PARAMETER OF COEFFICIENT ESTIMATION SECTION 414A |
|---|---|---|
| 0 | FILTER 01 | PARAMETER 01 |
| 30 | FILTER 02 | PARAMETER 02 |
| 60 | FILTER 03 | PARAMETER 03 |
| 90 | FILTER 04 | PARAMETER 04 |
| 120 | FILTER 05 | PARAMETER 05 |
| 150 | FILTER 06 | PARAMETER 06 |
| 180 | FILTER 07 | PARAMETER 07 |

(56) References Cited

U.S. PATENT DOCUMENTS

| | | | | |
|---|---|---|---|---|
| 2003/0185410 | A1 | 10/2003 | June et al. | |
| 2005/0140810 | A1 | 6/2005 | Ozawa | |
| 2005/0175190 | A1 | 8/2005 | Tashev et al. | |
| 2005/0259832 | A1 | 11/2005 | Nakano | |
| 2006/0245583 | A1* | 11/2006 | Mizushima et al. | 379/406.01 |
| 2007/0147634 | A1 | 6/2007 | Chu | |
| 2007/0160240 | A1 | 7/2007 | Ito et al. | |
| 2007/0185719 | A1 | 8/2007 | Miyazaki | |
| 2007/0211652 | A1* | 9/2007 | Minamiguchi et al. | 370/286 |
| 2010/0171743 | A1 | 7/2010 | Hata | |

FOREIGN PATENT DOCUMENTS

| | | | |
|---|---|---|---|
| JP | 6-233366 | A | 8/1994 |
| JP | 8-298696 | A | 11/1996 |
| JP | 2001-296343 | A | 10/2001 |
| JP | 2003-111198 | A | 4/2003 |
| JP | 2005-051744 | A | 2/2005 |
| JP | 2006-157857 | A | 6/2006 |
| JP | 2006-279099 | A | 10/2006 |
| JP | 2007-110744 | A | 4/2007 |
| JP | 2007-174190 | A | 7/2007 |
| JP | 2007-181099 | A | 7/2007 |
| JP | 2007-228069 | A | 9/2007 |
| JP | 2007-243722 | A | 9/2007 |
| WO | 99/35885 | A1 | 7/1999 |
| WO | 00/38414 | A1 | 6/2000 |
| WO | 2006004099 | A1 | 1/2006 |
| WO | 2009031595 | A1 | 3/2009 |

OTHER PUBLICATIONS

International Search Report issued in related PCT/JP2008/066108, mailed Dec. 9, 2008.

Extended European Search Report for corresponding application 08832266.4, dated Apr. 27, 2011.

European Office Action, Communication pursuant to Article 94(3) EPC for corresponding EP 09724331.5. Dated Feb. 27, 2012. Cited in co-pending U.S. Appl. No. 12/934,757.

OA issued Mar. 6, 2012 for corresponding JP 2007-245187 (English translation provided).

Notification of Reasons for Refusal for JP 2007-228683, mail date Oct. 9, 2012. Cited in related U.S. Appl. No. 12/676,535, translation provided.

* cited by examiner

FIG. 5

| ROTATION ANGLE OF ARM 11R | FILTER COEFFICIENT OF ADAPTIVE FILTER 412A | PARAMETER OF COEFFICIENT ESTIMATION SECTION 414A |
|---|---|---|
| 0 | FILTER 01 | PARAMETER 01 |
| 30 | FILTER 02 | PARAMETER 02 |
| 60 | FILTER 03 | PARAMETER 03 |
| 90 | FILTER 04 | PARAMETER 04 |
| 120 | FILTER 05 | PARAMETER 05 |
| 150 | FILTER 06 | PARAMETER 06 |
| 180 | FILTER 07 | PARAMETER 07 |

SOUND EMITTING AND COLLECTING APPARATUS

This application is a U.S. National Phase Application of PCT International Application PCT/JP2008/066108 filed on Sep. 5, 2008 which is based on and claims priority from JP 2007-245187 filed on Sep. 21, 2007 the contents of which is incorporated herein in its entirety by reference.

TECHNICAL FIELD

This invention relates to a sound emitting and collecting apparatus for emitting a sound based on a sound signal and collecting a sound to output a sound signal.

BACKGROUND ART

Hitherto, an acoustic echo canceller has been used as a device for removing an echo component routed from a loudspeaker to a microphone (for example, refer to Non-patent Document 1). The acoustic echo canceller estimates a transmission function of an acoustic transmission system from a loudspeaker to a microphone, thereby estimating an echo component and removing it from a sound collection signal.

Non-patent Document 1: "Acoustic systems and digital technology" edited by Juro OHGA, Yoshio YAMASAKI, and Yutaka KANEDA, the Institute of Electronics, Information and Communication Engineers, 1995, pp. 210-211

DISCLOSURE OF THE INVENTION

Problems to be Solved by the Invention

However, if the position of the loudspeaker or the microphone changes and the environment of the acoustic transmission system changes, the echo canceller in Non-patent Document 1 takes time until it again estimates the transmission function of the acoustic transmission system and may output an error signal.

It is therefore an object of the invention to provide a sound emitting and collecting apparatus that can accomplish stable echo removal if the relative positions of a loudspeaker and a microphone change.

Means for Solving the Problems

A sound emitting and collecting apparatus of the invention includes a sound emitting section that emits a sound based on a sound emitting signal; a sound collection section that collects a sound and generates a sound collection signal; an echo canceller having an adaptive filter for filtering the sound emitting signal and generating a pseudo echo signal, the echo canceller subtracting the pseudo echo signal from the sound collection signal to remove an echo component; a movable section on which the sound collection section is provided; a detection section that detects a movement and a move amount of the movable section; a storage section that stores a table defining a relationship between the move amount of the movable section and a filter coefficient of the adaptive filter; and a setting section, when the detection section detects the movement of the movable section, that inputs the move amount of the movable section from the detection section, read the filter coefficient corresponding to the move amount of the movable section from the storage section, and sets the read filter coefficient in the adaptive filter.

In the configuration, the sound collection section (microphone) is provided in the movable section. The move amount of the movable section is detected by the detection section of a sensor, etc. The relationship between the move amount and the filter coefficient is previously stored in the memory and when the movable section moves, the filter coefficient responsive to the move amount is set. Accordingly, if the positions of the loudspeaker and the microphone relatively changes, the appropriate filter coefficient can be set immediately and stable echo removal can be accomplished.

Further, in the invention, the setting section reads the filter coefficient of the adaptive filter after a lapse of a predetermined time from setting of the filter coefficient in the adaptive filter and stores the read filter coefficient in the storage section, thereby updating the filter coefficient corresponding to the move amount of the movable section defined in the table.

In the configuration, the memory storage contents are changed after a lapse of a predetermined time from setting of the filter coefficient. When a measure of time has elapsed, the adaptive filter automatically sets the optimum filter coefficient, so that the memory contents are updated using the already adapted filter coefficient and when the movable section next moves, the optimum filter coefficient can be set.

Further, in the invention, the echo canceller includes a coefficient update section for updating the filter coefficient in the adaptive filter based on the sound emitting signal and a residual signal in which the echo component is removed from the sound collection signal. The table further defines the relationship between the move amount of the movable section and an update parameter in the coefficient update section. The setting section reads the update parameter corresponding to the move amount of the movable section from the storage section and sets the read update parameter in the coefficient update section.

In the configuration, various parameters of the coefficient update section for updating the filter coefficient are changed in response to the move amount of the movable section. For example, various parameters are changed so as to promote update.

Further, in the invention, the echo canceller includes a delay circuit for giving a delay to the sound emitting signal and inputting the delayed signal into the adaptive filter. The table further defines the relationship between the move amount of the movable section and a delay amount of the delay circuit. The setting section reads the delay amount corresponding to the move amount of the movable section from the storage section and sets the read delay amount in the delay circuit.

In the configuration, the delay amount of the delay circuit provided at the preceding stage of the adaptive filter is changed. If the delay amount of the acoustic transmission system from the loudspeaker to the microphone changes, stable echo removal can be accomplished.

Advantages of the Invention

According to the invention, even if the relative positions of the loudspeaker and the microphone change, stable echo removal can be accomplished.

BRIEF DESCRIPTION OF THE DRAWINGS

FIG. 5 is a drawing to show a table defining the relationship among a rotation angle, a filter coefficient, and a parameter stored in memory 53.

DESCRIPTION OF REFERENCE NUMERALS

1 Sound emitting and collecting apparatus
10 Case
11L, 11R Arm
12L, 12R Hinge
13L, 13R Loudspeaker
15A, 15B, 15C Microphone array

BEST MODE FOR CARRYING OUT THE INVENTION

Figure 1:
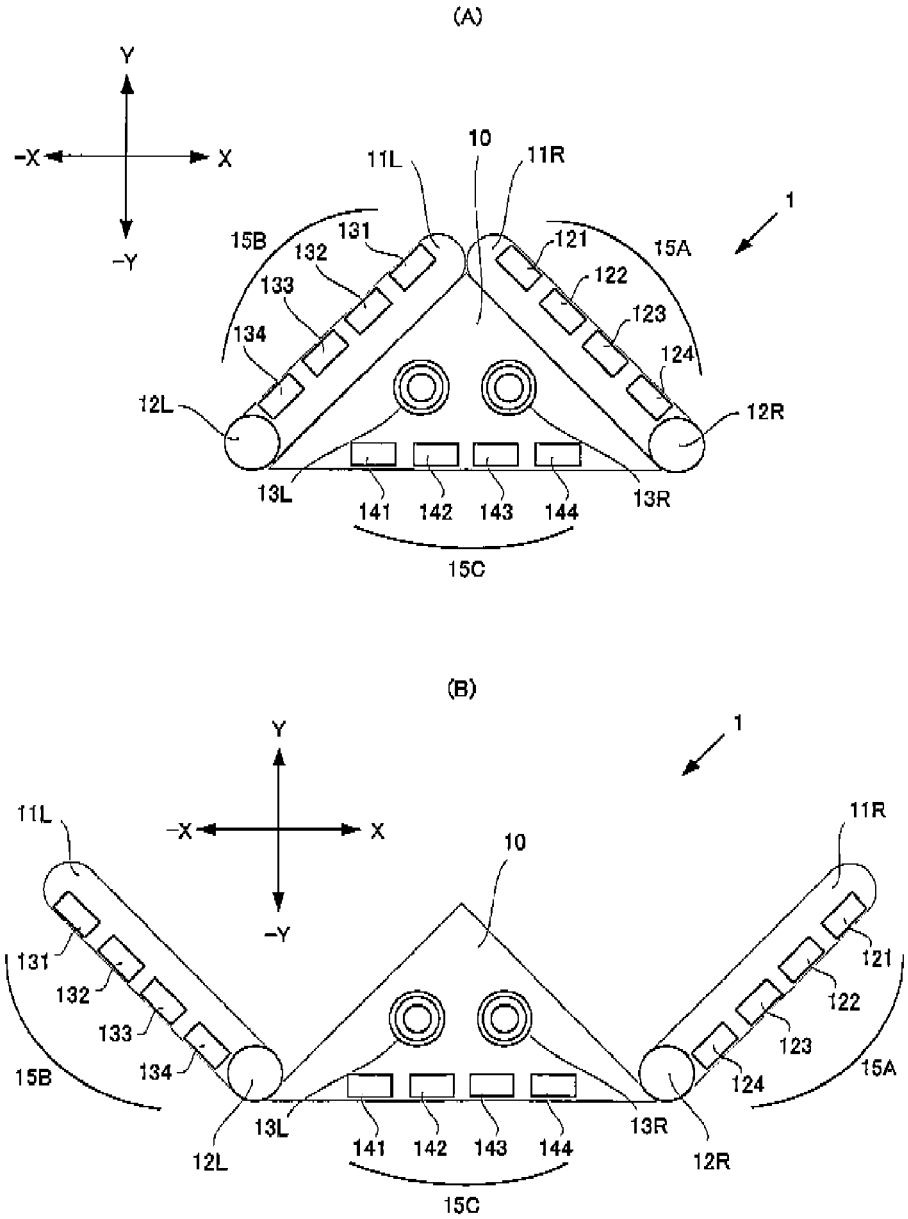
FIG. 1(A) is an outside drawing of a sound emitting and collecting apparatus with arms 11L and 11R in an initial state and (B) is an outside drawing of the sound emitting and collecting apparatus in a state in which the arms 11L and 11R are rotated about 90 degrees.
Figure 2:
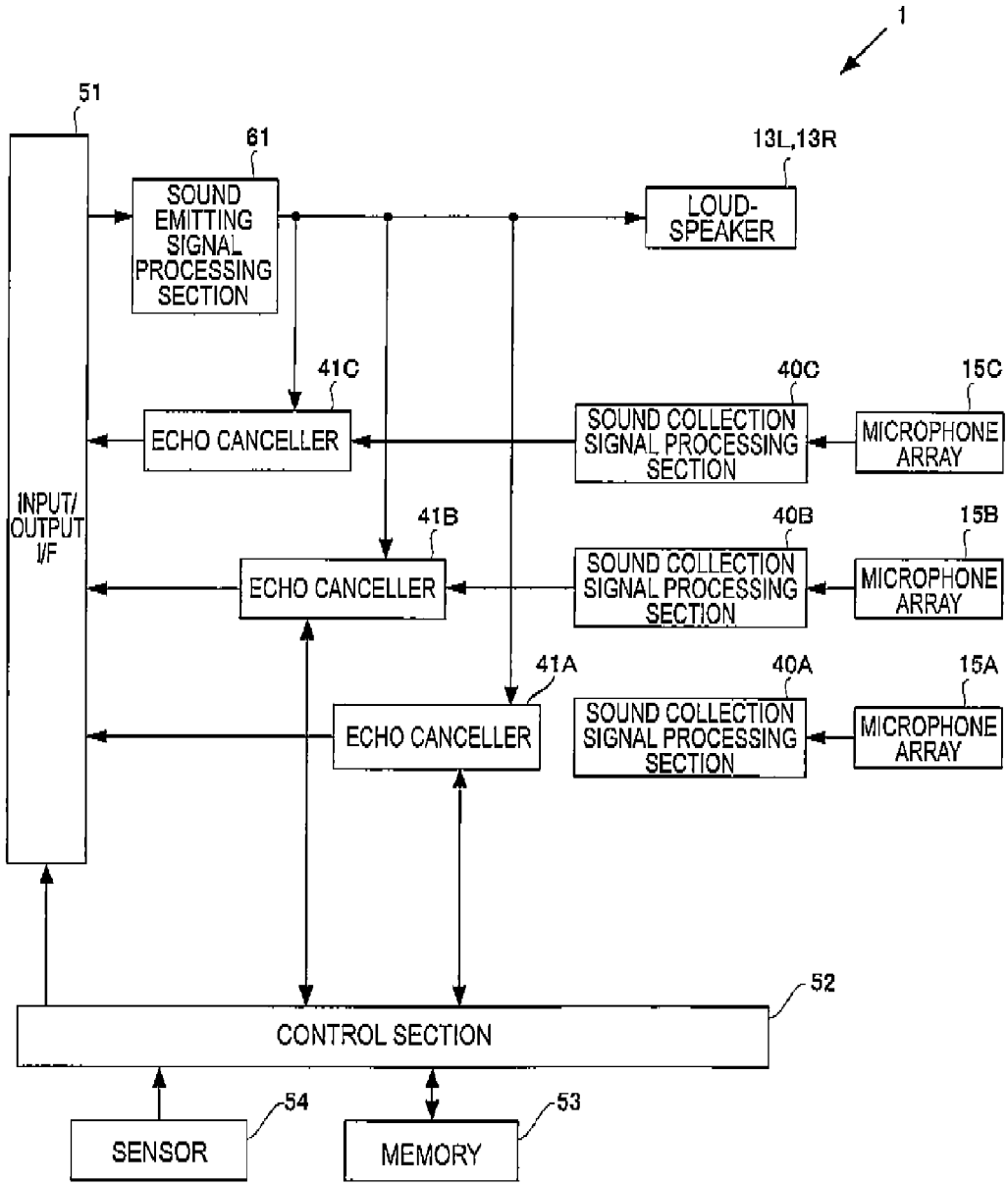
FIG. 2 is a block diagram to show the configuration of the sound emitting and collecting apparatus.

A sound emitting and collecting apparatus according to an embodiment of the invention will be discussed, FIGS. 1(A) and (B) are outside drawings (top views) of the sound emitting and collecting apparatus and FIG. 2 is a block diagram to show the configuration of the sound emitting and collecting apparatus. In FIGS. 1(A) and (B), the top side of the plane of the figure is a V direction, the bottom side of the plane of the figure is a −Y direction, the right side of the plane of the figure is an X direction, and the left side of the plane of the figure is a −X direction.

A sound emitting and collecting apparatus 1 includes a case 10, an arm 11L, an arm 11R, a hinge 12L, a hinge 12R, a loudspeaker 13L, a loudspeaker 13R, a microphone array 15A, a microphone array 15B, and a microphone array 15C on the appearance.

The case 10 has a triangle shape viewed from the top face (low triangle pole). The loudspeaker 13L and the loudspeaker 13R are provided in the vicinity of the center of the triangle. The microphone array I 5C is provided on the bottom side (−Y direction). The case 10 has the hinge 12L and the hinge 12R on the left and the right of the bottom side. The arm 11L is connected rotatably to the case 10 through the hinge 12L, and the arm 11R is connected rotatably to the case 10 through the hinge 12R.

The arm 11L and the arm 11R have the microphone array 15B and the microphone array 15A respectively. Each of the arm 11L and the arm 11R is shaped like a thin rod. One end portions of the arm 11L and the arm 11R are connected to the hinge 12L and the hinge 12R respectively. In a state shown in FIG. 1(A), the microphone array 15B is provided on the outside (−X, V direction) of one side of the long side of the arm 11L; likewise, the microphone array 15A is provided on the outside (X, Y direction) of one side of the long side of the arm 11R.

The microphone array 15A has a microphone unit 121, a microphone unit 122, a microphone unit 123, and a microphone unit 124 arranged in a line. Likewise, the microphone array 15B has a microphone unit 131, a microphone unit 132, a microphone unit 133, and a microphone unit 134 arranged in a line, and the microphone array 15C has a microphone unit 141, a microphone unit 142, a microphone unit 143, and a microphone unit 144 arranged in a line.

In FIG. 1(A), the sound collection direction of the microphone unit 121, the microphone unit 122, the microphone unit 123, and the microphone unit 124 is directed to the X, Y direction (the upper right of the plane of the figure). The sound collection direction of the microphone unit 131, the microphone unit 132, the microphone unit 133, and the microphone unit 134 is directed to the −X, Y direction (the upper left of the plane of the figure). The sound collection direction of the microphone unit 141, the microphone unit 142, the microphone unit 143, and the microphone unit 144 is directed to the −Y direction (the bottom of the plane of the figure).

The sound collected by each microphone unit is given a predetermined delay and then is combined, thereby the whole microphone array has strong sound collection directivity. For example, if the delays of all microphone units are the same, the sound in the front direction of each microphone is enhanced by combining and the sound in any other direction than the front direction is weakened by the combining. Consequently, strong directivity is provided on the front side of the microphone array.

The sound emitting directions of the loudspeaker 13L and the loudspeaker 13R are directed to the top face of the case 10, but the sounds are emitted with almost no directivity and thus propagate to the whole surroundings of the case 10.

In the sound emitting and collecting apparatus 1, when the arm 11L and the arm 11R are rotated, the sound collection directions of the microphone array 15B and the microphone array 15A can be changed. For example, as shown in FIG. 1(B), if the arm 11L is left rotated about 90 degrees, the sound collection direction of the microphone array 15B is directed to the −X, −Y direction (the lower left of the plane of the figure). If the arm 11R is right rotated about 90 degrees, the sound collection direction of the microphone array 15A is directed to the X, −Y direction (the lower right of the plane of the figure).

In FIG. 2, the sound emitting and collecting apparatus 1 includes an input/output interface (I/F) 51, a control section 52, a memory 53, a sensor 54, a sound collection signal processing section 40A, a sound collection signal processing section 40B, a sound collection signal processing section 40C, an echo canceller 41A, an echo canceller 41B, an echo canceller 41C, and a sound emitting signal processing section 61. In the figure, unless otherwise specified, signals transmitting in the apparatus are all digital signals.

The input/output I/F 51, the memory 53, the sensor 54, the echo canceller 41A, and the echo canceller 41B are connected to the control section 52.

The input/output I/F 51 has a line input/output terminal, a network terminal, etc., and inputs and outputs a sound signal from and to the apparatus outside. The input/output I/F 51 inputs a sound signal (sound emitting signal) input from the outside into the sound emitting signal processing section 61. The input/output I/F 51 outputs sound signals input from the echo canceller 41A, the echo canceller 41B, and the echo canceller 41C to the outside, The sound emitting signal processing section 61 adjusts the gain and the delay of the sound emitting signal and outputs the signal to the loudspeaker 13L, 13R. The sound emitting signal processing section 61 can output the sound emitting signal to both or either of the loudspeaker 13L and the loudspeaker 13R and is compatible with stereo output and monophonic output.

As described above, the gains and the delays of the sound emitting signals output to the loudspeaker 13L and the loudspeaker 13R are controlled, whereby the time difference and the sound volume difference of sound arriving at both ears of a listener are provided, whereby a virtual sound source can also be set, The sound signal (sound collection signal) collected by each microphone unit of the microphone array 15A is input to the sound collection signal processing section 40A, the sound collection signal collected by each microphone unit of the microphone array 15B is input to the sound collection signal processing section 40B, and the sound collection signal collected by each microphone unit of the microphone array 15C is input to the sound collection signal processing section 40C.

The sound collection signal processing section 40A adjusts the gain and the delay of the sound collection signal of each microphone unit and then combines and outputs the result to the following stage as a sound collection beam signal. Likewise, each of the sound collection signal processing section 40B and the sound collection signal processing section 40C also adjusts the gain and the delay of the sound collection signal of each microphone unit and then combines and outputs the result to the following stage as a sound collection beam signal.

The sound collection beam signal of the sound collection signal processing section 40A is input to the echo canceller 41A, the sound collection beam signal of the sound collection signal processing section 40B is input to the echo canceller 41B, and the sound collection beam signal of the sound collection signal processing section 40C is input to the echo canceller 41C.

Figure 3:
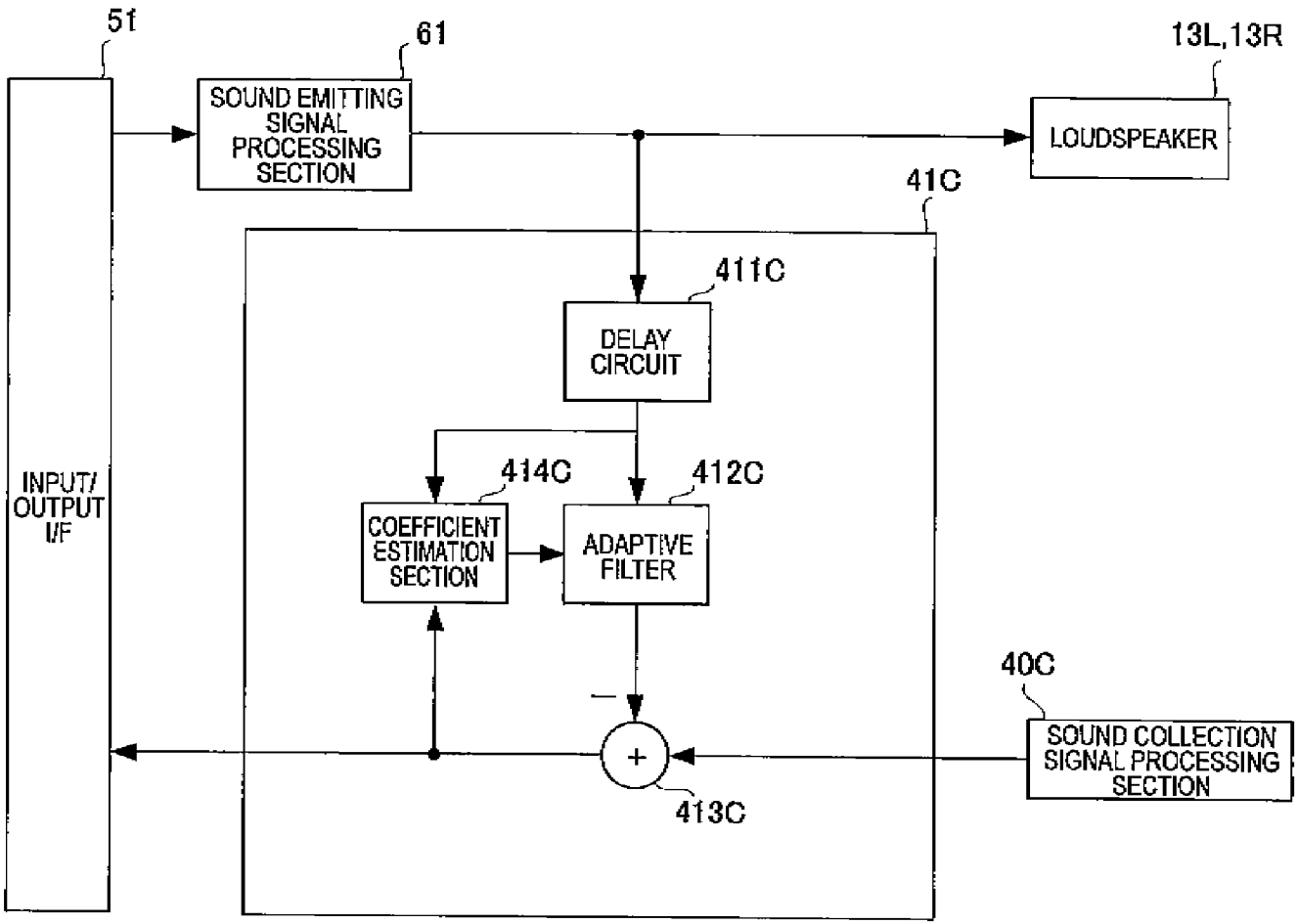
FIG. 3 is a block diagram to show the detailed configuration of an echo canceller 41C.
Figure 4:
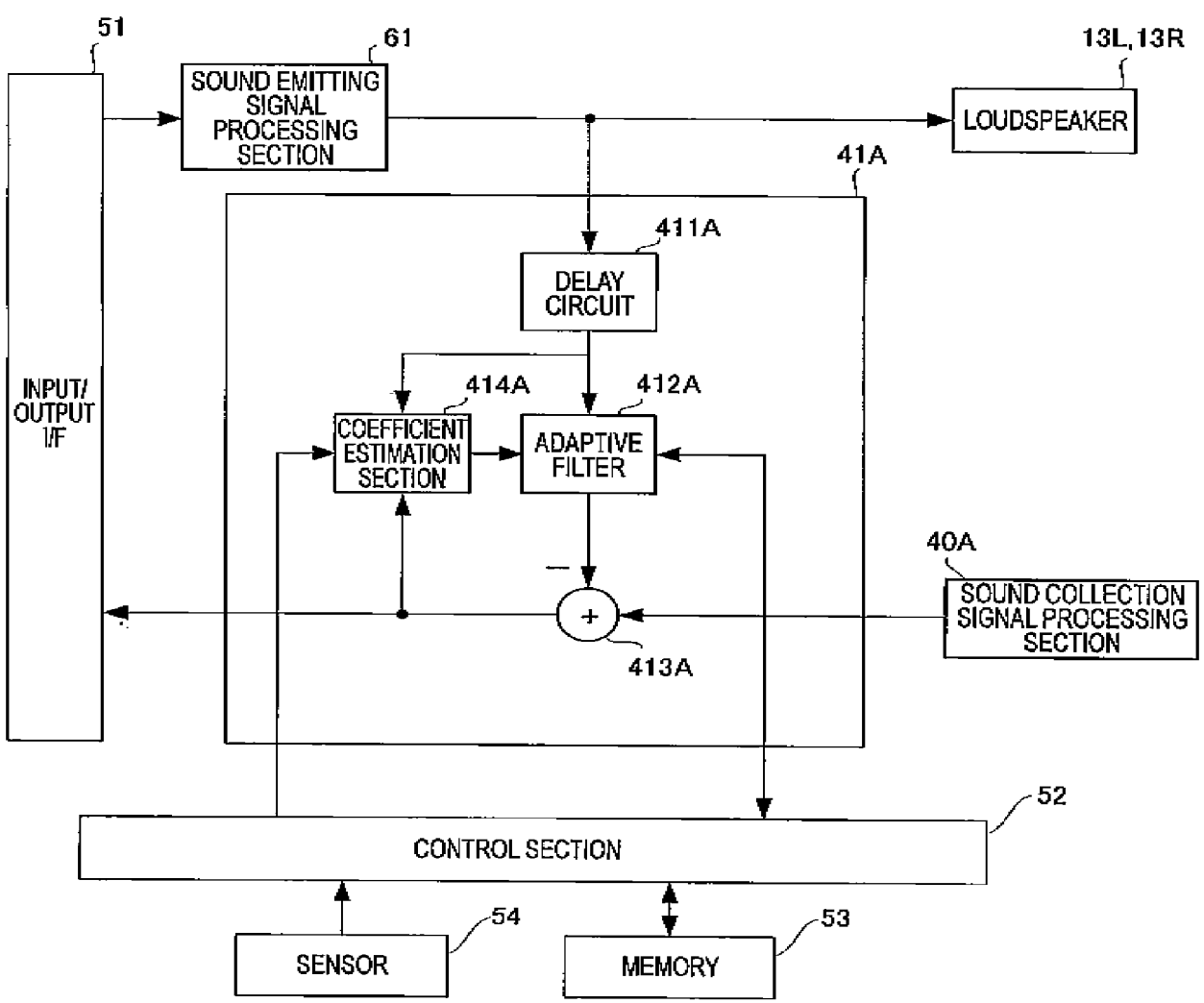
FIG. 4 is a block diagram to show the detailed configuration of an echo canceller 41A.

FIG. 3 is a block diagram to show the detailed configuration of the echo canceller 41C, and FIG. 4 is a block diagram to show the detailed configuration of the echo canceller 41A. The echo canceller 41A and the echo canceller 41B have the same configuration and therefore the configuration of the echo canceller 41A is shown in FIG. 4 as a representative.

First, in FIG. 3, the echo canceller 41C includes a delay circuit 411C, an adaptive filter 412C, an adder 413C, and a coefficient estimation section 414C.

The delay circuit 411C gives a predetermined delay to the sound emitting signal input from the sound emitting signal processing section 61. The delay corresponds to the delay of an acoustic transmission system from the loudspeaker 13L and the loudspeaker 13R to the microphone array 15C and is preset.

The sound emitting signal to which the delay is given by the delay circuit 411C is input to the adaptive filter 412C. The adaptive filter 4120 filters the sound emitting signal and generates an estimation component (which will be hereinafter referred to as pseudo echo signal) of a signal (echo component) routed from the loudspeaker 13L, 13R to the microphone array 15C. The generated pseudo echo signal is subtracted from the output signal of the sound collection signal processing section 40C by the adder 413C, thereby removing the echo component. That is, the adaptive filter 412C is a filter (FIR filter) simulating a transmission function of the acoustic feedback path from the loudspeaker to the microphone. The signal from which the echo component is removed is input to the input/output I/F 51 and the coefficient estimation section 414C.

The signal input to the input/output I/F 51 is output to the outside. The coefficient estimation section 414C detects a removal error of the echo component based on the input sound signal and the output signal of the delay circuit 411C and automatically updates a filter coefficient of the adaptive filter 412C to bring the pseudo echo signal close to the echo component.

The filter coefficient of the adaptive filter 412C is updated with various parameters such as a forgetting factor and a step size. The forgetting factor represents the speed of update; for example, if the forgetting factor is lessened, the filter coefficient so far is erased and update is promoted. The step size is a coefficient representing the magnitude of correction; if the step size is increased, the corrected filter coefficient is used more frequently and update is promoted. The environment in which the sound emitting and collecting apparatus will be used is estimated and the parameters are preset at the factory shipment, etc.

Thus, the adaptive filter 412C can update the filter coefficient in response to the installing environment of the sound emitting and collecting apparatus and can remove the echo component.

Next, as shown in FIG. 4, the echo canceller 41A includes a delay circuit 411A, an adaptive filter 412A, an adder 413A, and a coefficient estimation section 414A.

The delay circuit 411A, the adaptive filter 412A, the adder 413A, and the coefficient estimation section 414A have similar functions to those of the delay circuit 4110, the adaptive filter 412C, the adder 4130, and the coefficient estimation section 414C respectively. Thus, the components will not be discussed again in detail.

In the figure, the adaptive filter 412A and the coefficient estimation section 414A are connected to the control section 52. When the rotation angle of the arm 11L or the arm 11R changes, the control section 52 sets a filter coefficient of the adaptive filter 412A and a parameter of the coefficient estimation section 414A in response to an output signal of the sensor 54.

The sensor 54 is made of a rotary encoder, etc., incorporated in the hinge 12L and the hinge 12R, for example, and detects the rotation angles of the arm 11L and the arm 11R and outputs signals (rotation angle information) responsive to the rotation angles to the control section 52.

The control section 52 reads the corresponding filter coefficient and parameter from the memory 53 in response to the rotation angle information input from the sensor 54. The memory 53 stores the filter coefficients and the parameters responsive to the rotation angle information.

FIG. 5 is a drawing to show a table defining the relationship among the rotation angle, the filter coefficient, and the parameter stored in the memory 53. The figure shows a table defining the relationship among the rotation angle of the arm 11R, the filter coefficient, and the parameter; as for the arm 11L, similar relationship is also defined and a similar table is stored in the memory 53.

As shown in the figure, the table stores the filter coefficients and the parameters corresponding to the rotation angles every 30 degrees of the arm 11R (0, 30, 60, 90, 120, 150, and 180 degrees). The filter coefficients and the parameters are measured previously by experiment, etc. The values are updated as required in response to the actual use environment as described later.

When the rotation angle information input from the sensor 54 changes, for example, the rotation angle information after change indicates 90 degrees, the control section 52 reads filter 04 shown in the table of the figure and sets the filter 04 in the adaptive filter 412A. That is, the current filter coefficient set in the adaptive filter 412A is erased and is changed to the filter 04. Parameter 04 (forgetting factor, step size, etc.,) is read and is set in the coefficient estimation section 414A.

As described above, when the rotation angle of the arm 11L or the arm 11R changes, the previously defined filter coefficient and parameter are set, whereby even if the transmission function of the acoustic transmission system largely changes, stable echo removal can be accomplished. The previously defined filter coefficient, etc., is not necessarily an optimum value, but is more appropriate than the filter coefficient set before the arm angle changes because the value measured by an experiment, etc., is used as the reference.

The control section 52 stores the filter coefficient adapted (automatically updated in response to the actual environment) by the adaptive filter in the memory 53 after a lapse of several seconds, for example, since setting of the filter coefficient. For example, if the rotation angle information indicating 90 degrees is input and the filter coefficient is changed as mentioned above, the filter coefficient of the adaptive filter 412A after a lapse of several seconds is read and the filter 04 is updated. Accordingly, the optimum filter coefficient responsive to the installing environment is saved and when the arm angle is next changed, the optimum filter coefficient can be set immediately.

In the example described above, the filter coefficients, etc., corresponding to the rotation angles every 30 degrees are stored in the memory 53; however, if there is room for the memory capacity, the rotation angle can be defined more finely (for example, every 1 degree). If the same rotation angle as the rotation angle input from the sensor 54 is not defined, the filter coefficient corresponding to the closest rotation angle may be read.

Figure 6:
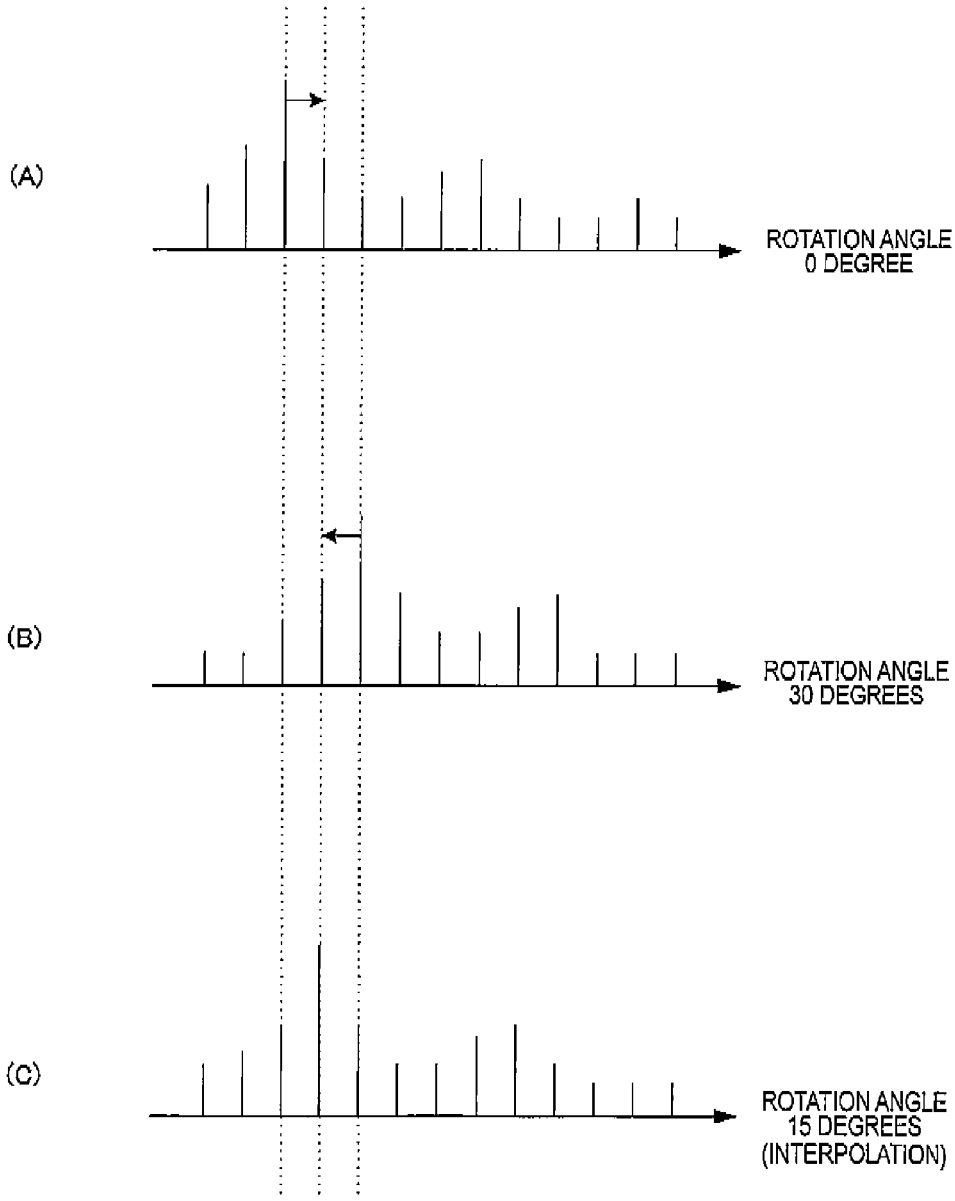
FIGS. 6(A), (B), and (C) are drawings to show an interpolating technique of the filter coefficient.

It is also possible to interpolate the filter coefficient corresponding to the rotation angle not stored in the memory 53 as follows:

FIGS. 6(A), (B), and (C) are drawings to show an interpolating technique of the filter coefficient. Each graph in the figures shows impulse response of adaptive filter; the horizontal axis indicates the time and the vertical axis indicates the level. In FIGS. 6(A), (B), and (C), the interpolating technique of the filter coefficient when the rotation angle changes to 15 degrees will be discussed. FIG. 6(A) shows the impulse response when the rotation angle is 0 degrees and FIG. 6(B) shows the impulse response when the rotation angle is 30 degrees.

When the rotation angle changes to 15 degrees, the control section 52 reads the filter coefficients before and after 15 degrees (0 degrees and 30 degrees), of the filter coefficients of the rotation angles stored in the memory 53. The impulse responses according to the filter coefficients become those shown in FIGS. 6(A) and (B). The control section 52 interpolates the filter coefficient of 15 degrees from the impulse responses. That is, the peak of the impulse response in FIG. 6(A) (peak of direct arrival sound) and the peak of the impulse response in FIG. 6(B) are detected and the average value of the peaks on the time axis is calculated. The average value is estimated to be the peak of the impulse response of the rotation angle 15 degrees. Further, the impulse responses shown in FIGS. 6(A) and (B) are moved on the time axis to the average value and the levels are averaged. The value thus averaged is adopted as the impulse response of the rotation angle 15 degrees. Accordingly, the filter coefficient corresponding to the rotation angle 15 degrees is found and is set in the adaptive filter. If there is room for the capacity of the memory 53, the filter coefficients thus interpolated may be stored in the memory 53.

In the embodiment described above, the filter coefficient of the adaptive filter and various parameters of the coefficient estimation section are set by way of example; however, those set when the rotation angle changes may be only the filter coefficient or may be the parameters of the coefficient estimation section. In addition, the number of taps of the adaptive filter may be changed or the delay amount of the delay circuit may be changed.

If the number of taps is larger than the actual reverberation time, a signal of an opposite phase may be added without distributing to removal of the echo component and a different signal is added. Conversely, if the number of taps is large, the computation amount grows and a burden is imposed on processing of the adaptive filter. Then, the number of taps responsive to the actual acoustic transmission system is set, whereby stable echo removal can be accomplished.

If the position of the microphone array changes, the distance between the loudspeaker and the microphone array changes and thus the delay amount of the acoustic transmission system also changes. If the, delay amount of the delay circuit is too large as compared with the delay amount of the acoustic transmission system, a signal with a large delay from the time delay of the actual echo component is input to the adaptive filter and it becomes impossible to estimate the echo component. Then, the delay amount of the delay circuit is changed, whereby stable echo component removal can be accomplished.

While the invention has been described in detail with reference to the specific embodiments, it will be obvious to those skilled in the art that various changes and modifications can be made without departing from the spirit and the scope or the intention of the invention.

This application is based on Japanese Patent Application (No. 2007-245187) filed on Sep. 21, 2007, the content of which is incorporated herein by reference.

The invention claimed is:

1. A sound emitting and collecting apparatus comprising:

a sound emitting section that emits a sound based on a sound emitting signal;

a sound collection section that collects a sound and generates a sound collection signal;

an echo canceller having an adaptive filter for filtering the sound emitting signal and generating a pseudo echo signal, the echo canceller subtracting the pseudo echo signal from the sound collection signal to remove an echo component;

a movable section on which the sound collection section is provided;

a detection section that detects a movement and a move amount of the movable section;

a storage section that stores a table defining a relationship between the move amount of the movable section and a filter coefficient of the adaptive filter; and a setting section, when the detection section detects the movement of the movable section, that inputs the move amount of the movable section from the detection section, reads the filter coefficient corresponding to the move amount of the movable section from the storage section, and sets the read filter coefficient in the adaptive filter, wherein the echo canceller includes a delay circuit for giving a delay to the sound emitting signal and inputting the delayed signal into the adaptive filter;

wherein the table further defines the relationship between the move amount of the movable section and a delay amount of the delay circuit; and wherein the setting section reads the delay amount corresponding to the move amount of the movable section from the storage section and sets the read delay amount in the delay circuit.

2. The sound emitting and collecting apparatus according to claim 1, wherein the echo canceller includes a coefficient update section for updating the filter coefficient of the adaptive filter based on the sound emitting signal and a residual signal in which the echo component is removed from the sound collection signal;

wherein the table further defines a relationship between the move amount of the movable section and an update parameter in the coefficient update section, the update parameter for updating the filter coefficient of the adaptive filter; and wherein the setting section reads the update parameter corresponding to the move amount of the movable section from the storage section and sets the read update parameter in the coefficient update section.

* * * * *